US008540552B2

(12) United States Patent
Reukers

(10) Patent No.: US 8,540,552 B2
(45) Date of Patent: Sep. 24, 2013

(54) WATER JET CUTTING MACHINE

(75) Inventor: Darren J. Reukers, Campbellfield (AU)

(73) Assignee: Techni WaterJet Pty Ltd, Victoria (AU)

( * ) Notice: Subject to any disclaimer, the term of this patent is extended or adjusted under 35 U.S.C. 154(b) by 815 days.

(21) Appl. No.: 12/597,327

(22) PCT Filed: Apr. 24, 2008

(86) PCT No.: PCT/AU2008/000575

§ 371 (c)(1),
(2), (4) Date: Mar. 9, 2010

(87) PCT Pub. No.: WO2008/128303

PCT Pub. Date: Oct. 30, 2008

(65) Prior Publication Data

US 2010/0173570 A1 Jul. 8, 2010

(30) Foreign Application Priority Data

Apr. 24, 2007 (AU) ..... 2007902173
Dec. 21, 2007 (AU) ..... 2007907053

(51) Int. Cl.
*B24C 3/00* (2006.01)

(52) U.S. Cl.
USPC ..... 451/91; 451/75; 451/86; 451/102

(58) Field of Classification Search
USPC ..... 451/36–40, 91, 99, 2, 5, 8, 9, 75, 451/86, 102; 83/53, 34, 177, 589, 699.51, 83/829, 548; 175/6; 408/180, 187
See application file for complete search history.

(56) References Cited

U.S. PATENT DOCUMENTS

| | | | | |
|---|---|---|---|---|
| 4,458,766 | A | 7/1984 | Seigel | |
| 4,854,091 | A * | 8/1989 | Hashish et al. | 451/38 |
| 4,936,059 | A * | 6/1990 | Hashish et al. | 451/99 |
| 5,255,853 | A * | 10/1993 | Munoz | 239/433 |
| 5,653,560 | A * | 8/1997 | Weber et al. | 408/1 R |
| 5,759,086 | A * | 6/1998 | Klingel | 451/28 |
| 6,283,832 | B1 * | 9/2001 | Shepherd | 451/40 |
| 6,419,566 | B1 * | 7/2002 | Palmisano | 451/78 |
| 6,543,462 | B1 * | 4/2003 | Lewis et al. | 134/144 |
| 6,705,921 | B1 * | 3/2004 | Shepherd | 451/2 |
| 6,981,906 | B2 * | 1/2006 | Hashish et al. | 451/2 |
| 7,464,630 | B2 * | 12/2008 | Knaupp et al. | 83/177 |
| 7,803,036 | B2 * | 9/2010 | Sciulli et al. | 451/9 |
| 2002/0066345 | A1 | 6/2002 | Shepherd et al. | |
| 2004/0048548 | A1 | 3/2004 | Shepherd | |

FOREIGN PATENT DOCUMENTS

| | | |
|---|---|---|
| JP | 10029198 | 2/1998 |
| JP | 2000238032 | 9/2000 |

* cited by examiner

*Primary Examiner* — George Nguyen
(74) *Attorney, Agent, or Firm* — Stites & Harbison PLLC; Douglas E. Jackson

(57) ABSTRACT

A profile cutting apparatus comprising: a cutting head supporting a nozzle through which a cutting medium passes, and at least two drives that drive the cutting head to tilt relative to a vertical axis while driving the cutting head to rotate about the vertical axis, wherein the tilt of the cutting head is achieved by the relative difference in motion between the two drives.

18 Claims, 14 Drawing Sheets

WATER JET CUTTING MACHINE

The present invention relates to a profile cutting apparatus having improved performance, and in particular a waterjet cutting apparatus.

BACKGROUND OF THE INVENTION

Profile cutting apparatus have been used for some years to cut a variety of materials such as steel, aluminium, glass, marble, plastics, rubber, cork and wood. Examples of profile cutting apparatus include waterjet cutting machines, plasma cutting machines and laser cutting machines.

Taking waterjet cutting machines as an example, the work piece is placed over a shallow tank of water and a cutting head expelling a cutting jet is accurately displaced across the work piece to complete the desired cut. The cutting action is carried out by the combination of a very high pressure jet (up to 60,000 psi) of water entrained with fine particles of abrasive material, usually sand, that causes the cutting action. The water and sand that exit the cutting head are collected beneath the work piece in the tank.

The abrasive material is usually particles of silica sand, cast iron grit, powdered garnet or alumina. The particle size of the abrasive material is usually between 60 and 150 mesh.

The high pressure water jet is usually passed through a venturi that is connected to a vacuum line that is in turn connected to an abrasive metering assembly that meters dry abrasive delivered from a hopper and carried by the vacuum to the cutting head at a desired flow rate that is often between about 100 to 700 grams per minute.

This cutting technique is very powerful and can cut through stainless steel as thick as 100 mm or 4 inches. The cutting process can also be extremely accurate with tolerances of plus or minus 0.1 mm or 0.004 inches. The process is clean, fast and reliable. Nevertheless, the resulting cutting path is limited to the movement parameters of the apparatus and certain cutting paths of varying degrees of sophistication are unable to be achieved with known waterjet cutting apparatus.

There is therefore a need to improve the performance and versatility of profile cutting apparatus such as waterjet cutting apparatus.

SUMMARY OF THE INVENTION

In accordance with the present invention there is provided a profile cutting apparatus comprising: a cutting head supporting a nozzle through which a cutting medium passes, and at least two drives that drive the cutting head to tilt relative to a vertical axis while driving the cutting head to rotate about the vertical axis, wherein the tilt of the cutting head is achieved by the relative difference in motion between the two drives.

In a preferred embodiment of the invention the drives each include a drive shaft and the tilt of the cutting head is achieved by the relative difference in speed and angular displacement between the drive shafts. The drive shaft of one drive rotates a rotary assembly which supports the cutting head and rotates the cutting head around the vertical axis, while the other drive shaft drives a tilt assembly supported on the rotary assembly and tilts the cutting head relative to the vertical axis. The rotary assembly carries the tilt assembly such that the assemblies rotate in unison so that while the drives may operate separately, together they drive the interconnected rotary and tilt assemblies to achieve rotation and tilt of the cutting head.

In accordance with the present invention there is further provided a profile cutting apparatus comprising: a cutting head supporting a nozzle through which a cutting medium passes, at least two drives that drive the cutting head to tilt relative to a vertical axis while driving the cutting head to rotate about the vertical axis, and a delivery column through which cutting medium passes from a top thereof and which rotates with the cutting head so that a conduit can deliver the cutting medium from the bottom of delivery column to the cutting head without twisting.

BRIEF DESCRIPTION OF THE DRAWINGS

Embodiments of the present invention will now be described by way of example only with reference to the accompanying drawings in which:

FIG. 3(*b*) is an enlarged view of the delivery column and gear drives of FIG. 3(*a*);

FIG. 9(*b*) is an enlarged view of Area A indicated in FIG. 9(*a*);

DETAILED DESCRIPTION OF PREFERRED EMBODIMENT

The present invention relates to a profile cutting apparatus with particular reference made to a waterjet cutting apparatus. Although not specifically described, it is understood that the invention also relates to other profile cutting apparatus including laser and plasma cutting apparatus.

The drawings illustrate two embodiments of a waterjet cutting apparatus 10, 30, also described as a cutting head assembly, having improved performance in terms of manoeuvrability and versatility resulting in accurate and complex cutting paths not previously achievable with known waterjet cutting apparatus. The apparatus 10, 30 typically form part of a larger waterjet cutting machine (not shown) having arms or tracks in the first three spatial linear dimensions, namely the X, Y and Z dimensions, in order to move the apparatus 10 in these dimensions. The apparatus are typically located above a shallow bath, or tank, of water over which the workpiece sits.

The present waterjet cutting apparatus introduces an additional two spatial dimensions of movement, namely a fourth and fifth axis. Such a machine comprising the waterjet cutting apparatus is therefore defined as having five axis of movement.

The fourth axis is referred to as the tilt from the vertical axis, ie. the roll about the horizontal axis, while the fifth axis is referred to as the vertical axis around which the waterjet nozzle spins, or rotates. The combination and extent of movement capable on the apparatus' fourth and fifth axis achieves cutting movements not previously attainable.

Figure 3A:
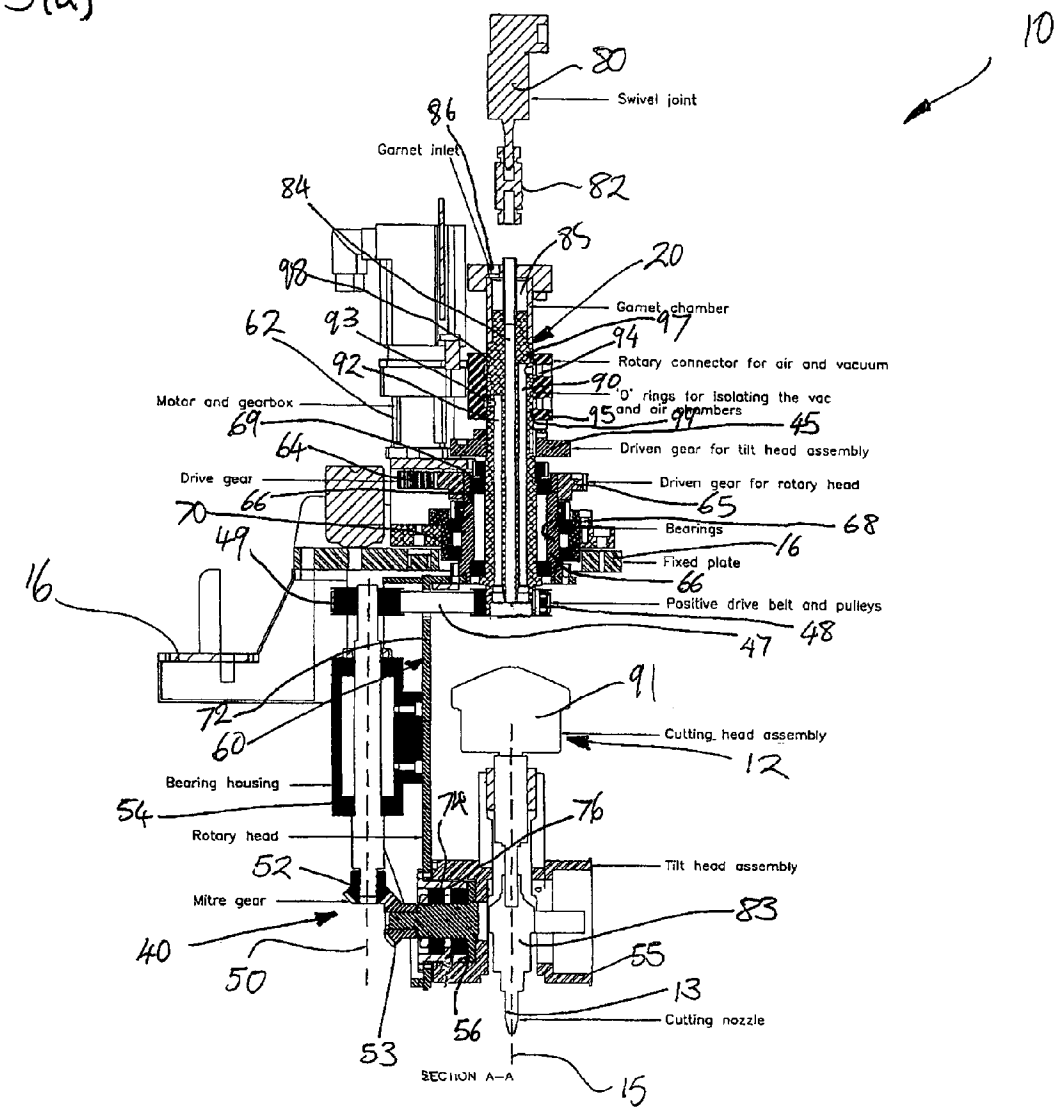
FIG. 3(*a*) is a side sectional view of the apparatus taken at section A-A of FIG. 2.
Figure 3B:
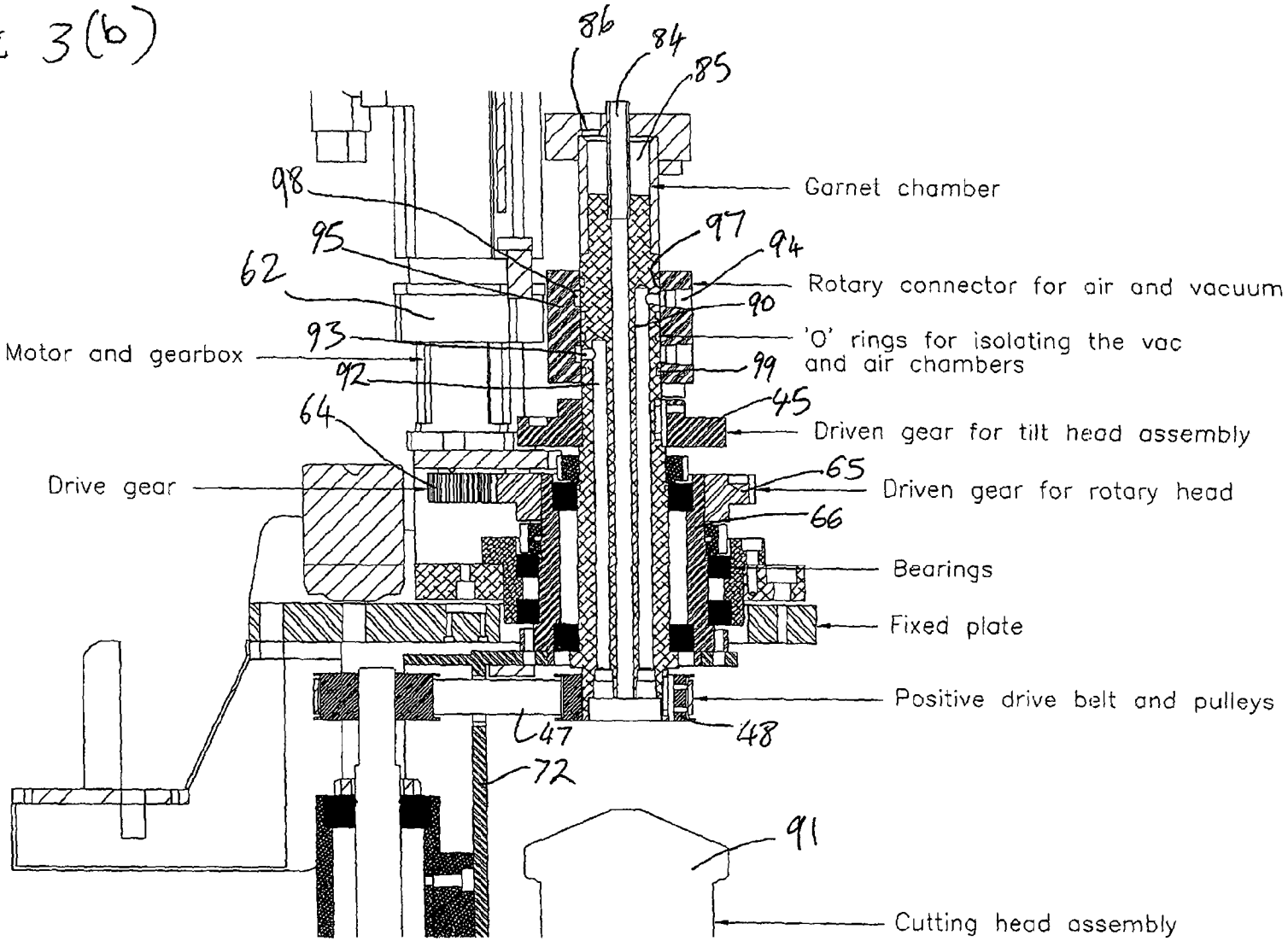

A first embodiment of the waterjet cutting apparatus 10 is illustrated in FIGS. 1 to 7 and comprises a cutting head 12 supporting a high pressure waterjet nozzle 13 coupled to a source of abrasive material (not shown) deliverable to the nozzle via a vacuum line 90, wherein the cutting head 12 is driven to be tilted relative to a main vertical axis 15 (see FIGS. 3(*a*), 3(*b*) and 4) and to also be continuously rotated about the main vertical axis such that the waterjet nozzle 13 can cut a continuous circular path. When the apparatus moves only in the fourth and fifth dimensions to describe a circular path, the circular path described can be greater than 360°. With movement in the first, second and/or third dimensions, together with movement in the fourth and fifth dimensions, endless possibilities of cutting profiles are achievable, for example, a flat spiral coil.

The continuous rotation of the waterjet beyond 360° is made possible because electrical cables for motors, etc, and air, water and garnet conduits are largely moved away from the moving cutting head and located above the moving components. In this way the cutting head is free to rotate without twisting and tangling cables and conduits restricting its movement.

Furthermore, the tilt movement of the cutting head as well as the rotational movement is driven by the relative difference in motion of separate drives. That is, the motion of the separate drives is interconnected so that one drive function affects the other to produce a combined outcome. This arrangement allows full rotational and tilting movement of the cutting head while keeping drive motors fixed to a base and away from the movement of the cutting head.

Two drives are provided in the preferred embodiment of the apparatus, although it may be possible to use more that two drives to achieve the same outcome. For the purpose of clearly describing the apparatus 10, 30, the two drives are loosely attributed to either the tilt movement or the rotational movement. Similarly, the tilt movement of the cutting head 12 is loosely effected by a tilt head assembly 40 and the rotational movement by a rotary head assembly 60. In reality, the tilt and rotational movement of the cutting head are brought about by the differential manner in which the drives operate.

The tilt head and rotary head assemblies 40, 60 each include a motor and drive system such as gears, wherein the tilt movement and the rotational movement are driven along the same main vertical axis 15 and are able to interact in unison and/or at different speeds.

Figure 1:
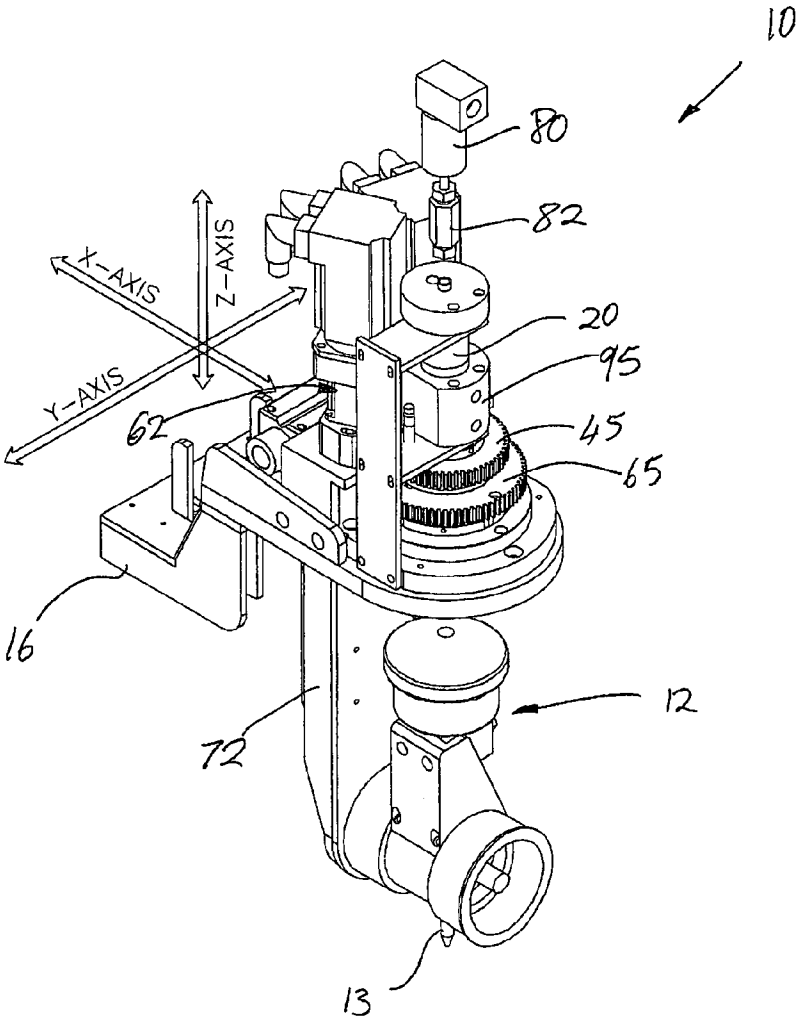
FIG. 1 is an isometric view of a waterjet cutting apparatus in accordance with a first embodiment of the present invention.
Figure 2:
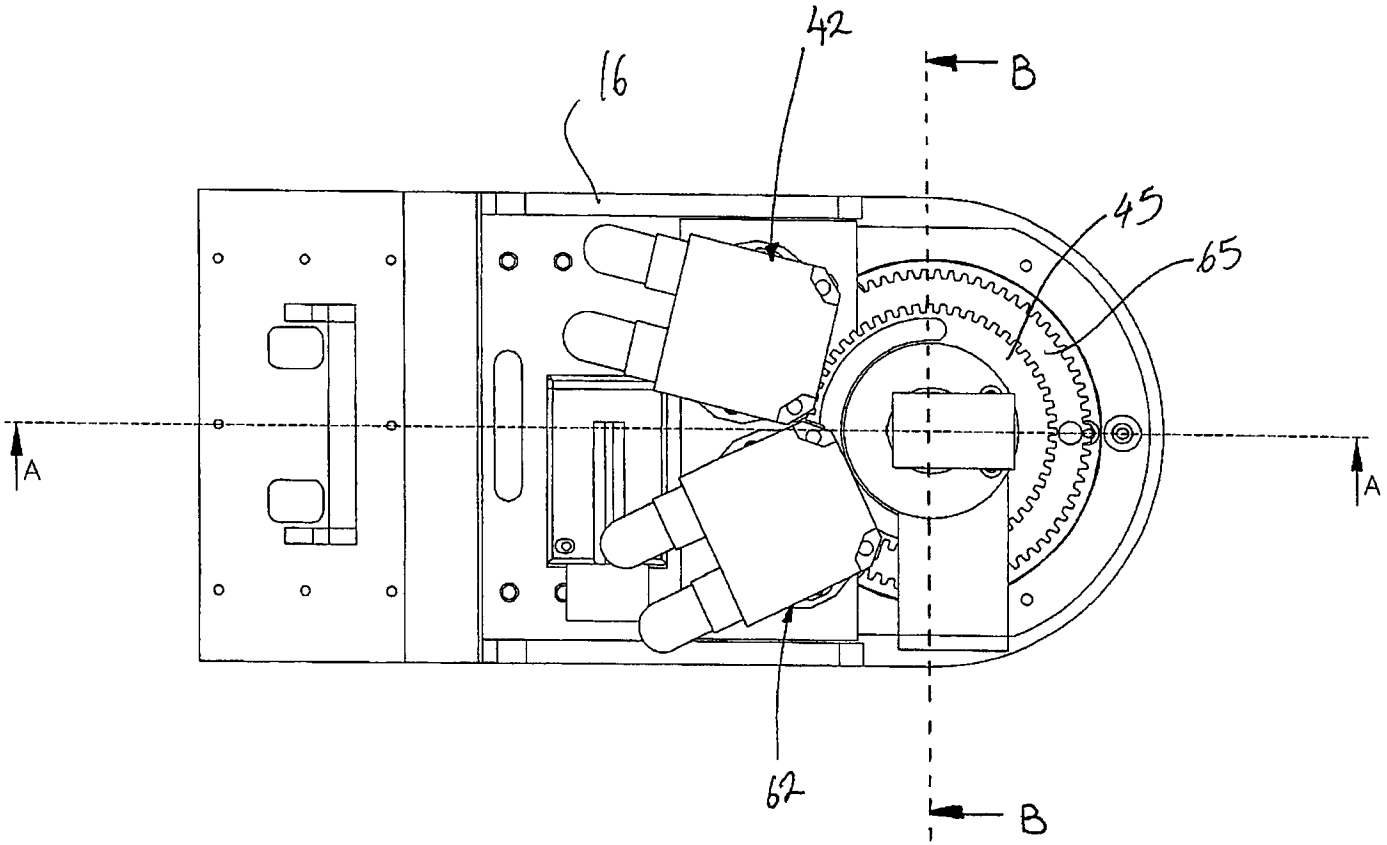
FIG. 2 is a plan view of FIG. 1.

As illustrated in the first embodiment in FIG. 1, the cutting head 12, tilt head assembly 40 and rotary head assembly 60 are all supported on a fixed platform 16. The fixed platform 16 itself forms part of a larger cutting machine comprising tracks that move the fixed platform, and hence waterjet nozzle, in the X, Y and Z directions.

Figure 7:
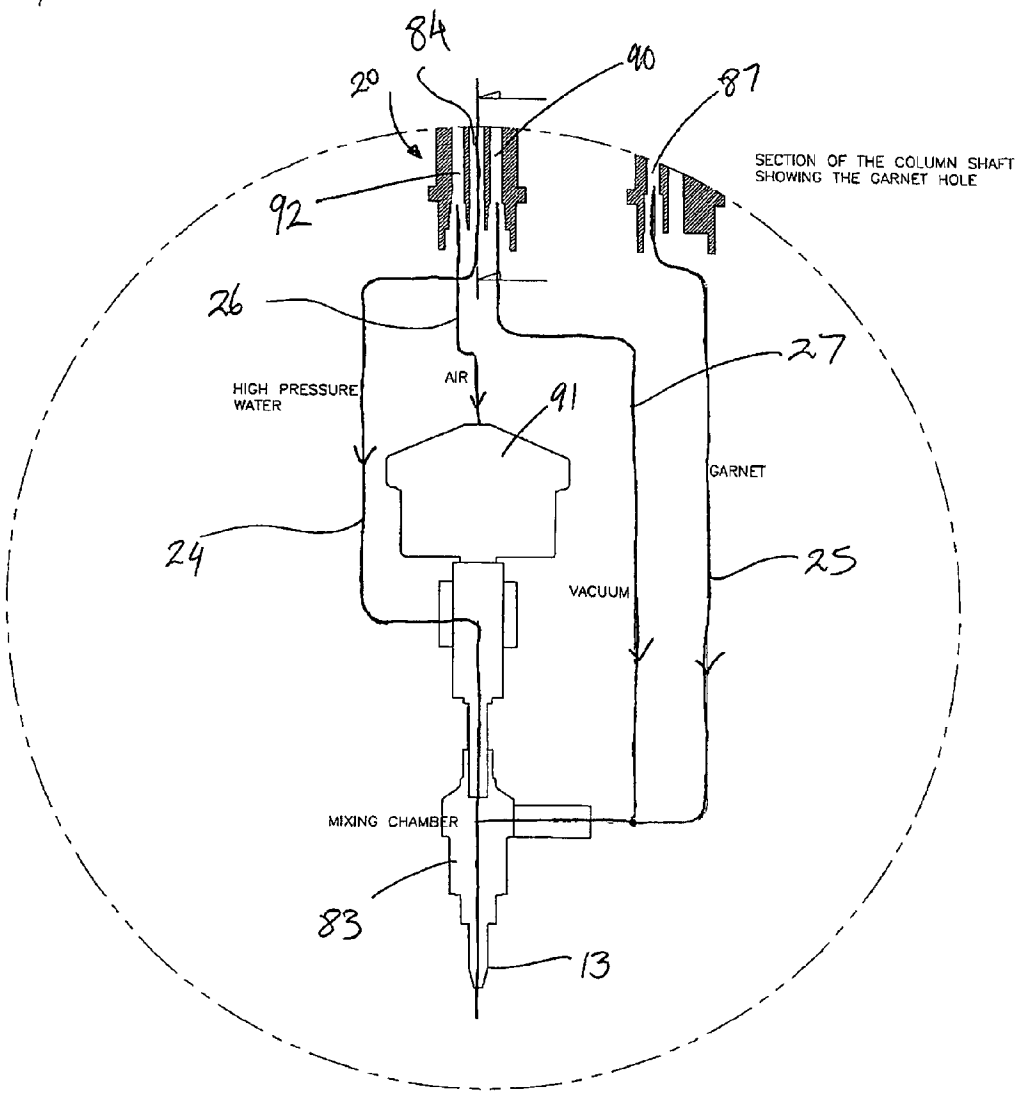
FIG. 7 schematically illustrates the cutting head assembly of the waterjet cutting apparatus.
Figure 8:
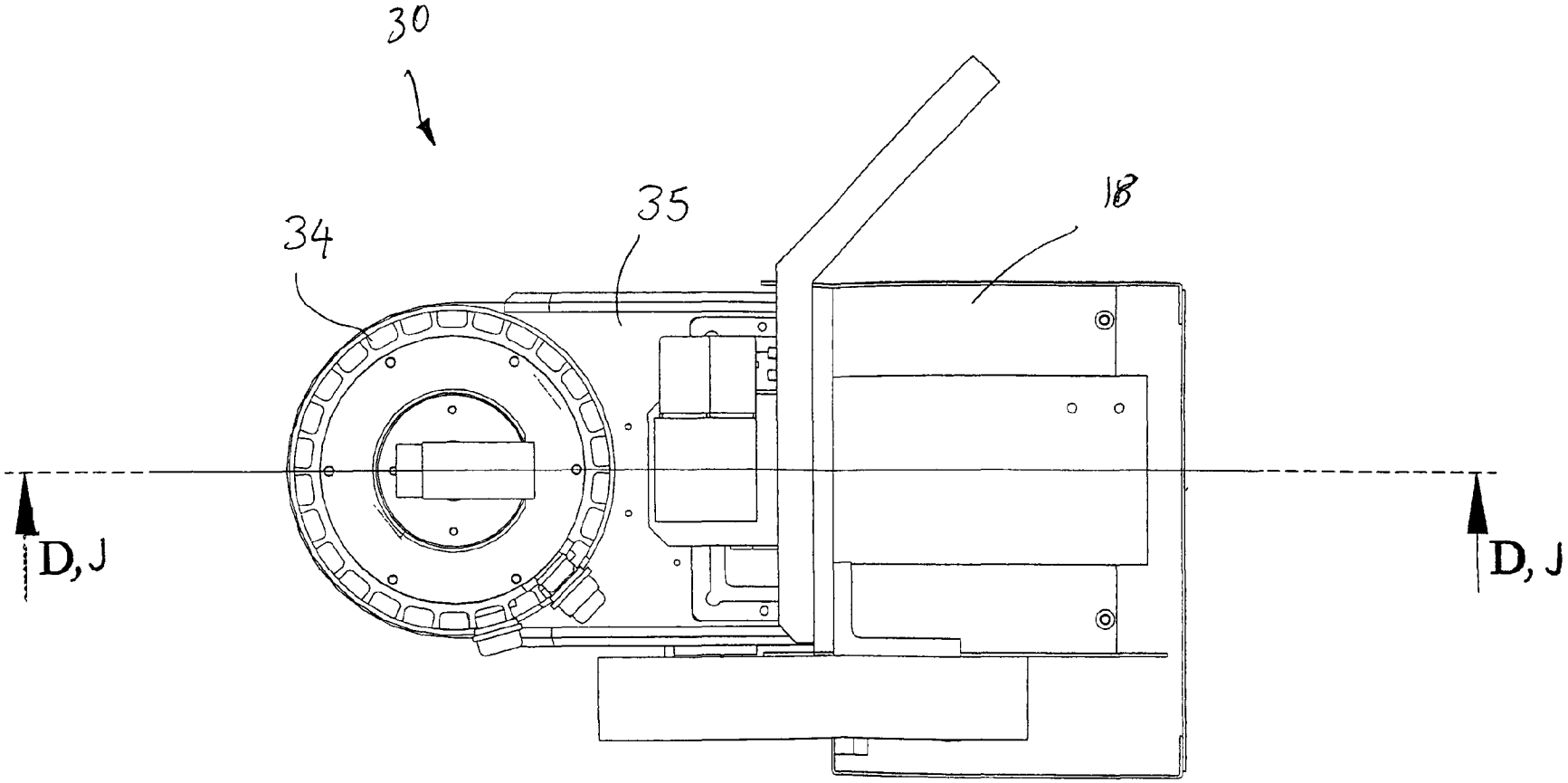
FIG. 8 is a plan view of waterjet cutting apparatus in accordance with a second embodiment of the present invention.

Delivery of high pressure water and abrasive material is through a delivery column 20 mounted on the fixed platform 16 and rotatable relative to the fixed platform 16 and with the rotary assembly 40 about the vertical axis 15 (FIG. 3(*a*)), which is also the main longitudinal axis of the delivery column 20. The delivery column is coupled to the cutting head 12 located below the fixed platform by way of service conduits including a high pressure water tube 24, a garnet tube 25, and air 26 and vacuum 27 tubes so as to deliver an abrasive high pressure water stream through the nozzle 13. Tubes 24-27 are not illustrated in FIG. 3(*a*), but are schematically illustrated in FIG. 7.

The tilt head assembly 40 includes a first motor 42 supported on and fixed to platform 16. First motor 42 drives a first drive gear 44 (FIG. 6) which in turn drives a column gear 45. The column gear 45 is axially aligned with the vertical axis 15 and, more specifically, supports the delivery column 20, which in this instance is also the drive shaft associated with the tilt head assembly. The delivery column 20 is supported through the axial centre of the column gear such that rotation of the column gear rotates, or spins, the delivery column about the vertical axis 15. Column gear 45 is located above fixed platform 16 and is keyed into a side of delivery column 20 to be fixed thereto.

Coupled to the delivery column at a point below the fixed platform 16 is a positive drive belt/pulley arrangement, which is driven by rotation of the delivery column. The drive belt/pulley arrangement includes a first pulley gear 48 coupled to the end of delivery column 20. Through a drive belt 47 first pulley gear drives a second pulley gear 49 having an offset axis 50 spaced from and parallel to main vertical axis 15.

The second pulley gear 49 is coupled to drive a first bevelled, or mitred, gear 52 aligned along the same offset axis 50 which in turn imparts drive through 90° to a mating second bevelled gear 53. First bevelled gear 52 is supported to rotate within a bearing housing 54. Second bevelled gear 53 is fixed to a tilt head frame 55 which supports the cutting head 12. Rotation of the second bevelled gear rotates the tilt head frame 55 and hence the cutting head. The degree of tilt is greater than ±12° which is the standard maximum for most waterjet cutting machines, and typically at least between ±60° relative to the vertical axis 15, if not more.

This large degree of tilt is possible because of the interaction between the motors of the tilt head assembly and the rotary head assembly and the motors' ability to operate interactively at variable speeds.

In the above description of the tilt head assembly incorporating gears and pulley arrangements, it is understood that variations in, and a different selection of, drive mechanisms is possible to achieve the same drive result, namely to tilt the cutting head 12 by driving the tilt action along the main vertical axis on which the delivery column 20 lies.

The rotary head assembly 60 includes a second motor 62 driving a second drive gear 64 to rotate a rotary head gear 65. The rotary head gear 65 drives a rotary head frame 66 which wholly supports the tilt head assembly 40, and hence the delivery column 20 and cutting head 12, for rotational movement. Hence, rotation of the rotary head assembly rotates the tilt head assembly, delivery column and cutting head.

The rotary head has a hollow shaft 68 which is coaxial with the delivery column, and through which the delivery column is supported therein by column bearings 69. Delivery column 20 is therefore rotatable within shaft 68. The shaft 68 of the rotary head is also supported by bearings, namely head bearings 70, on the fixed platform 16 to allow the rotary head to rotate relative to the fixed platform.

Below the hollow shaft, the rotary head frame also includes a bracket 72 which extends down to and is coupled with the tilt head frame 55 through tilt head bearings 74. More specifically, and as shown in FIG. 3(*a*), a collar 76 at the lower end of bracket 72, slides by way of a clearance fit into a corresponding rebate 56 in the tilt head frame 55. Collar 76 is adapted to rotate within rebate 56 through tilt head bearings 74. Extending centrally through collar 76 and on bearings 74 is the second bevelled gear 53 which is bolted to tilt head frame 55.

This arrangement therefore allows the second bevelled gear to rotate, or tilt, the tilt head frame 55, while the entire tilt head frame is supported through the rotary head bracket 72 and collar 76.

Consequently, and with tilt head frame 55 supported by the rotary head assembly 60, second motor 62 drives the rotary head frame 66 to rotate, or spin, tilt head frame about the vertical axis 15. Hence cutting head 12 and nozzle 13 can also be rotated about the vertical axis.

Because the tilt head assembly and rotary head assembly are differentially connected along the delivery column, rotation of one assembly will affect the other. In a simple example, if no tilting action of the cutting head is desired, i.e. such that the jet stream spins on the spot, both motors 42, 62 are driven to rotate the tilt head and rotary head assemblies at the same velocity. A change in drive velocity of one or the other motor, ie. a differential in the motors' drive, will cause a tilt. The degree of tilt furthermore depends on the relative angular displacement of one motor output relative to the other or, put another way, on the angular displacement of the tilt assembly's drive shaft (the delivery column 20) relative to the hollow shaft 68 of the rotary assembly.

For example, by applying motion to motor 42 and holding motor 62 stationary, the cutting head will tilt relative to the vertical axis (the $4^{th}$ Axis). By then rotating both motor 42 & 62 at a constant relative speed the cutting head will rotate around the vertical axis (the $5^{th}$ Axis). This rotation allows the waterjet stream to be positioned relative to the direction of motion in order to achieve the desired bevel angle.

If the nozzle had been tilted to 45° relative to the vertical plane and had been rotated to 90° relative to the X axis, and the X axis is then driven in either a plus or minus direction, the result would be a 45° cut along the X axis.

A more complex example would be to continually rotate the cutting head around the vertical axis to maintain 90° relative to the axis of motion, while moving the X and Y axis in a circular spiral motion, resulting in a coil spring design with a 45° bevel. The design allows for infinite adjustment of both the bevel angle and angle relative to the axis of motion, meaning that there is no known limit to the shapes that can be profile cut with the invention.

In combination, the tilt of the cutting head 12 with the cutting head spinning about the vertical axis 15 can produce a circular cutting path that can be continuously described without impediment from apparatus components or without conduits tangling.

Figure 6:
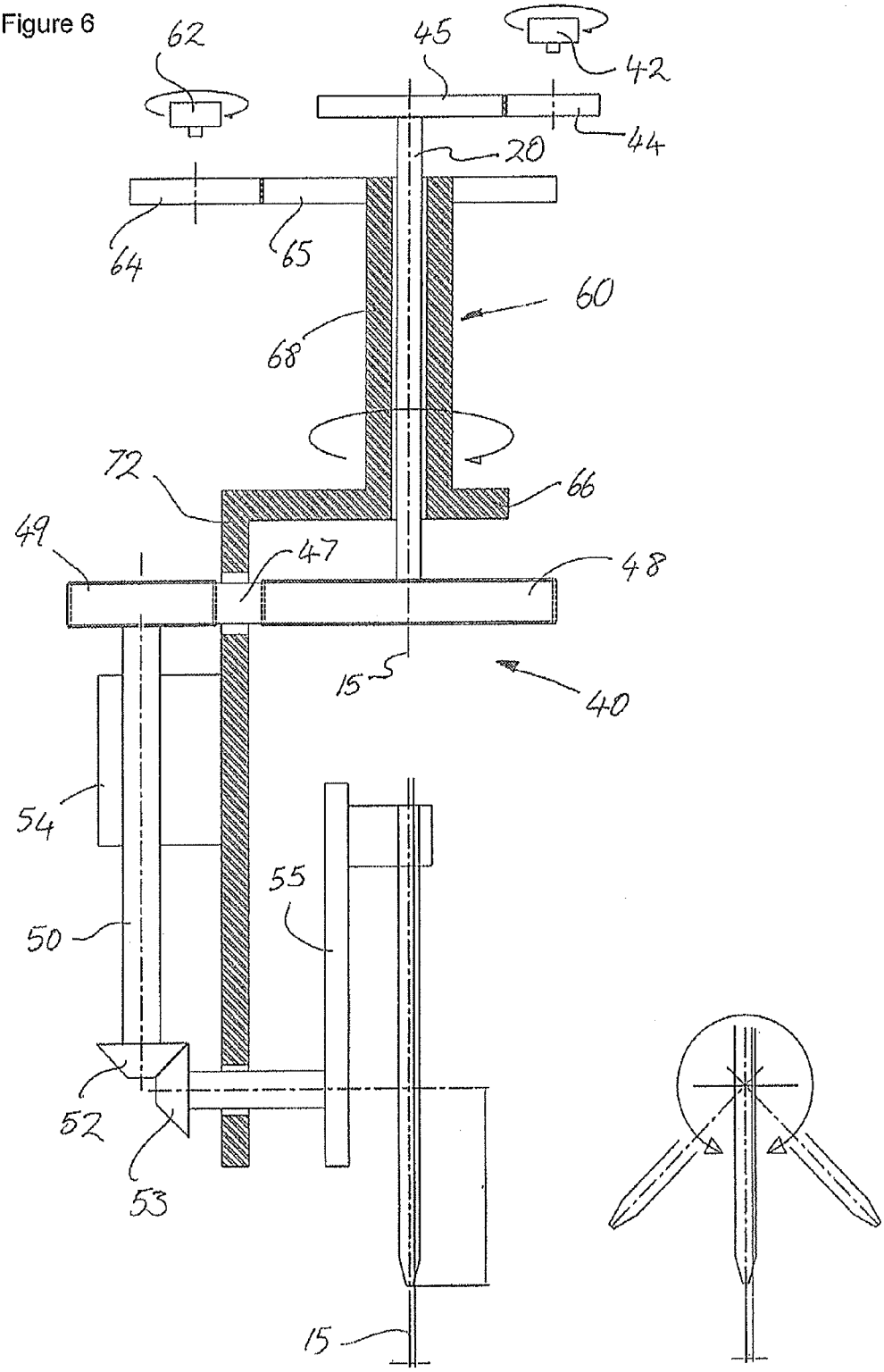
FIG. 6 is a schematic drawing illustrating the relative movements of the first embodiment of the waterjet cutting apparatus.

FIG. 6 schematically and simplistically shows the interaction of the tilt head assembly and rotary head assembly. As shown, rotary head frame 66 supports tilt head assembly 40 and is itself entirely rotatable.

The resulting cutting path, without any movement in the first three dimensions, is a continuous circular path that can, with a continuous change in the degree of tilt, spiral inwardly or outwardly. Relatively increasing or decreasing the rotational speed of the tilt head or rotary head assemblies can produce a variety of free form open or closed shapes. With movement in the first three dimensions, the cutting path may follow an infinite number of variable path directions.

FIGS. 3(*a*), 3(*b*), 4 and 5 illustrate from different views the interior of the delivery column of the first embodiment. In the second embodiment described the top of the delivery column (also tilt head rotor 36) is best seen in FIG. 9(*b*).

Delivery column 20, 36 delivers to the cutting head a mixture of high pressure water and garnet, usually in the form of sand. High pressure water from a pipe (not shown) is introduced into delivery column through a swivel joint 80 and through an adapter 82 which is connected to an upper end of the delivery column to deliver high pressure water into a water passage 84 through the column. The high pressure water exits from a mixing chamber 83 at the lower end of the delivery column and into one or more conduits 24 and a venturi (not shown) in the cutting head 12 which deliver the water mixed with garnet to nozzle 13.

Figure 4:
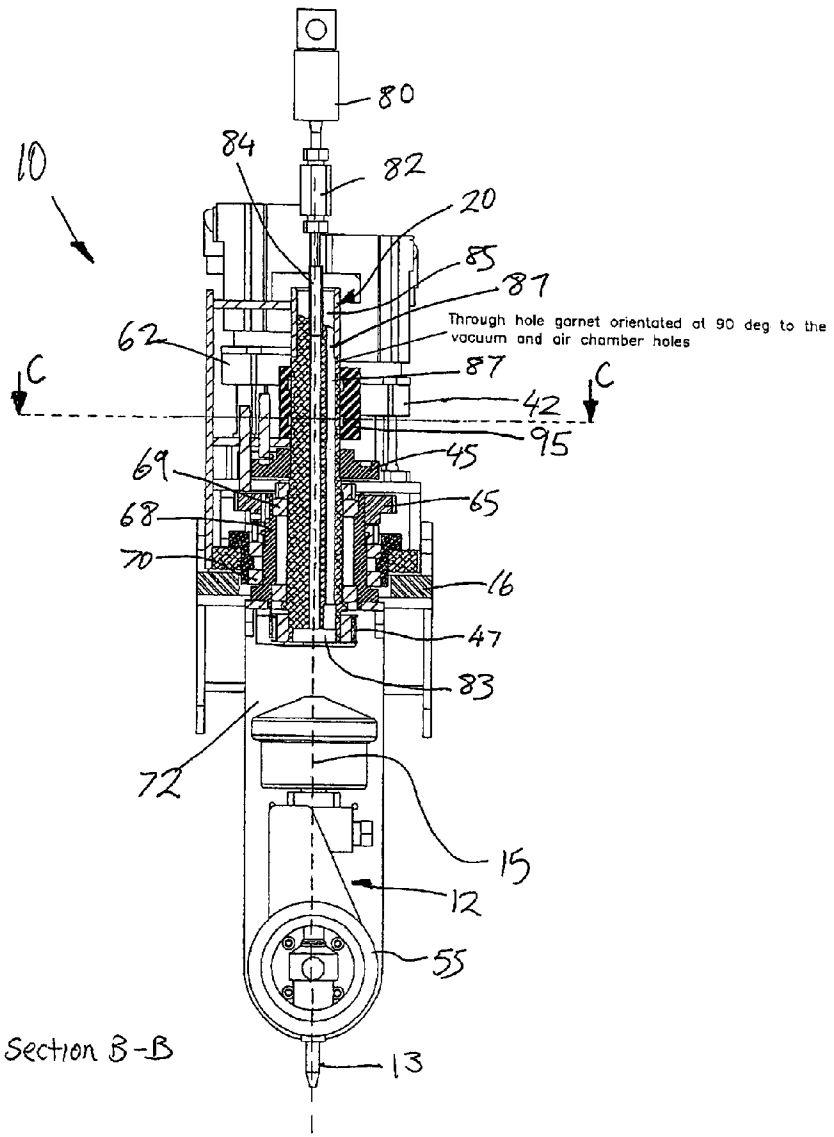
FIG. 4 is a front sectional view of the apparatus taken at section B-B of FIG. 2.
Figure 5:
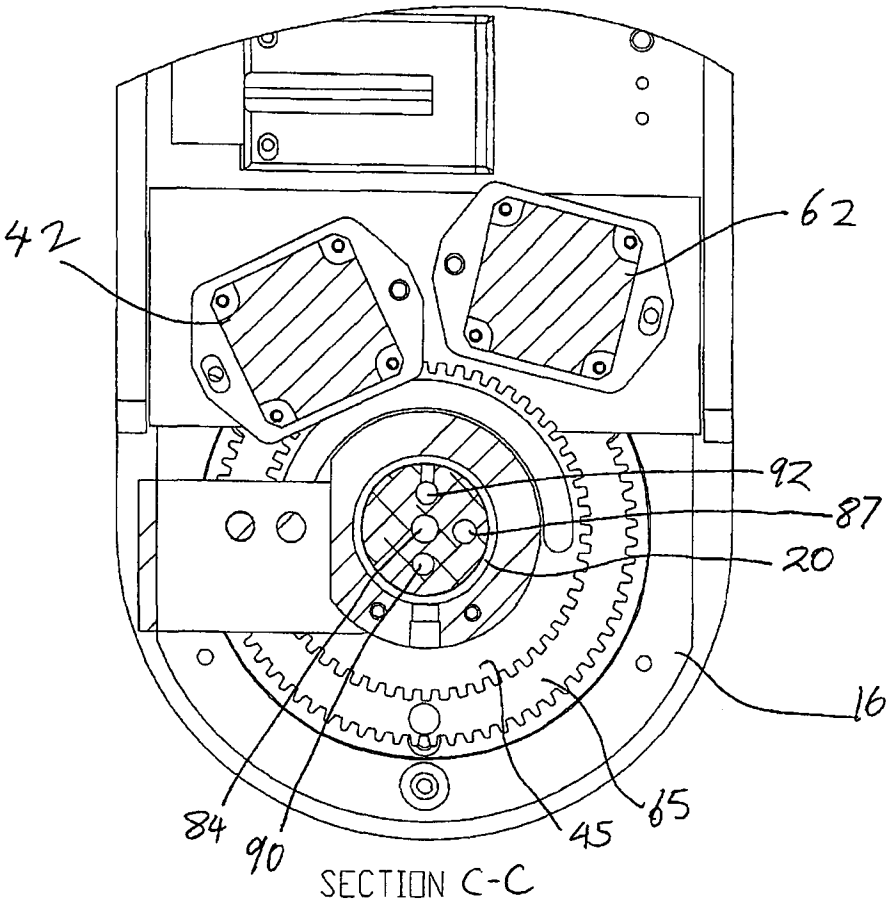
FIG. 5 is a plan sectional view of the apparatus taken at section C-C of FIG. 4.
Figure 9A:
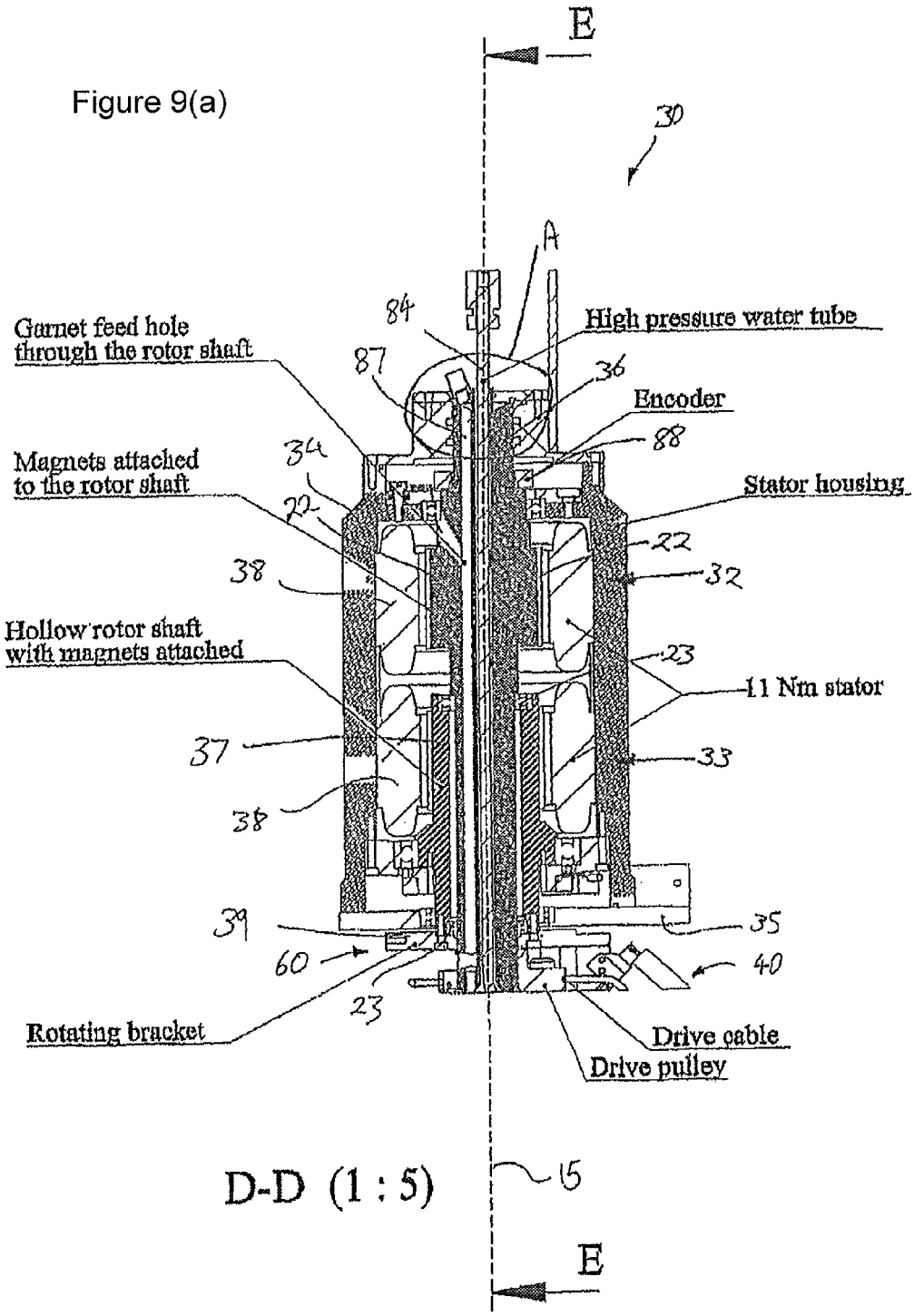
FIG. 9(*a*) is a first side sectional view of an upper half of the apparatus taken at section D-D of FIG. 8.
Figure 9B:
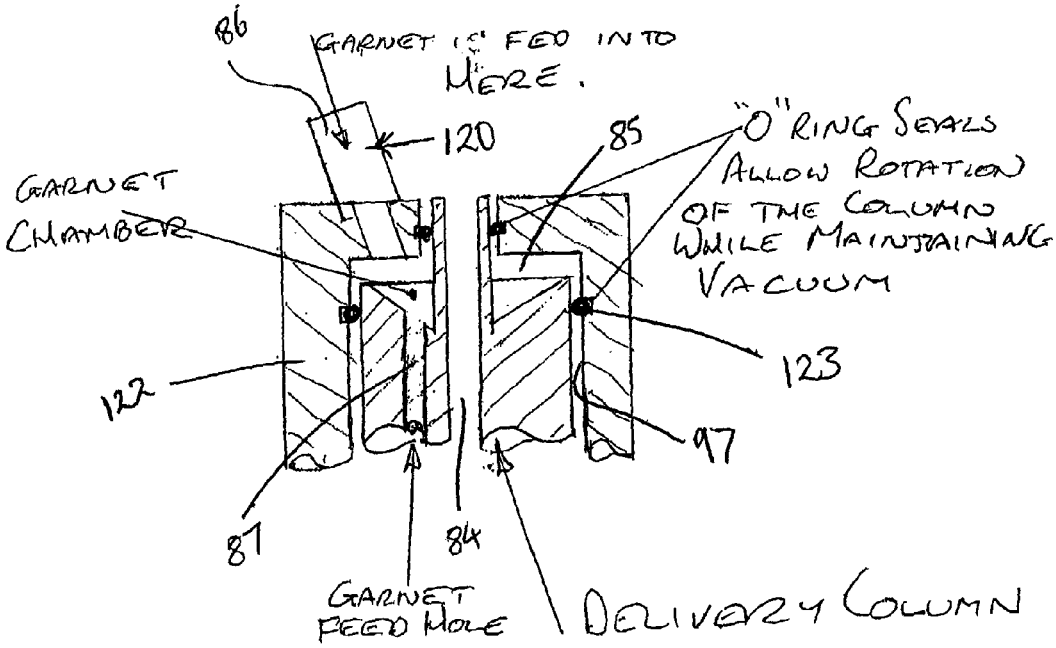

Reference to the delivery column 20 in the first embodiment is made to the front sectional view of FIG. 4 and plan view of FIG. 5, while reference to the delivery column 36 in the second embodiment is made to FIGS. 9(*a*), 9(*b*) and 10. Garnet is introduced under a vacuum into a sealed garnet chamber 85 by connecting a conduit from a garnet source to a fitting 120 and dropping the garnet through an inlet 86. Garnet chamber 85 is defined by an upper end of the delivery column 20, 36 and a stationary cylindrical housing 122 fixed to the stator housing 34 (in the second embodiment). Garnet inlet 86 is located in the cylindrical housing 122 so that the conduit from the garnet source also remains stationary relative to the tilt and rotary drive systems.

Garnet chamber 85 is sealed all around with O-rings 123 to maintain a vacuum environment while still allow rotation of the delivery column 20, 36 with respect to the cylindrical housing 122.

From the garnet chamber 85 garnet is drawn into garnet passage 87 under vacuum created by a venturi set up in the cutting head and is delivered down the delivery column through garnet passage 87 to be mixed with the water stream in the mixing chamber 83 located in the cutting head assembly immediately above the cutting nozzle.

To pneumatically open and close jetstream delivery of water in water passage 84 through the cutting head, air is introduced through an air passage into air valve 91. FIG. 3 illustrates air passage 92 and the vacuum passage 90 on either side of the water passage 84. The inlets to the air and vacuum passages are part way down the delivery column 20, 36. The vacuum passage is connected to a sensing device which monitors the performance of the cutting head.

FIG. 7 illustrates delivery of fluids and material from delivery column 20 through flexible conduits to the cutting head 12. High pressure water is delivered from water passage 84 through water tube 24 to the cutting head, which in turn sets up a venturi in mixing chamber 83 to draw garnet through garnet tube 25. Air is delivered to air valve 91 through air tube 26, while vacuum sensing is carried out on the cutting head through vacuum tube 27.

Figure 10:
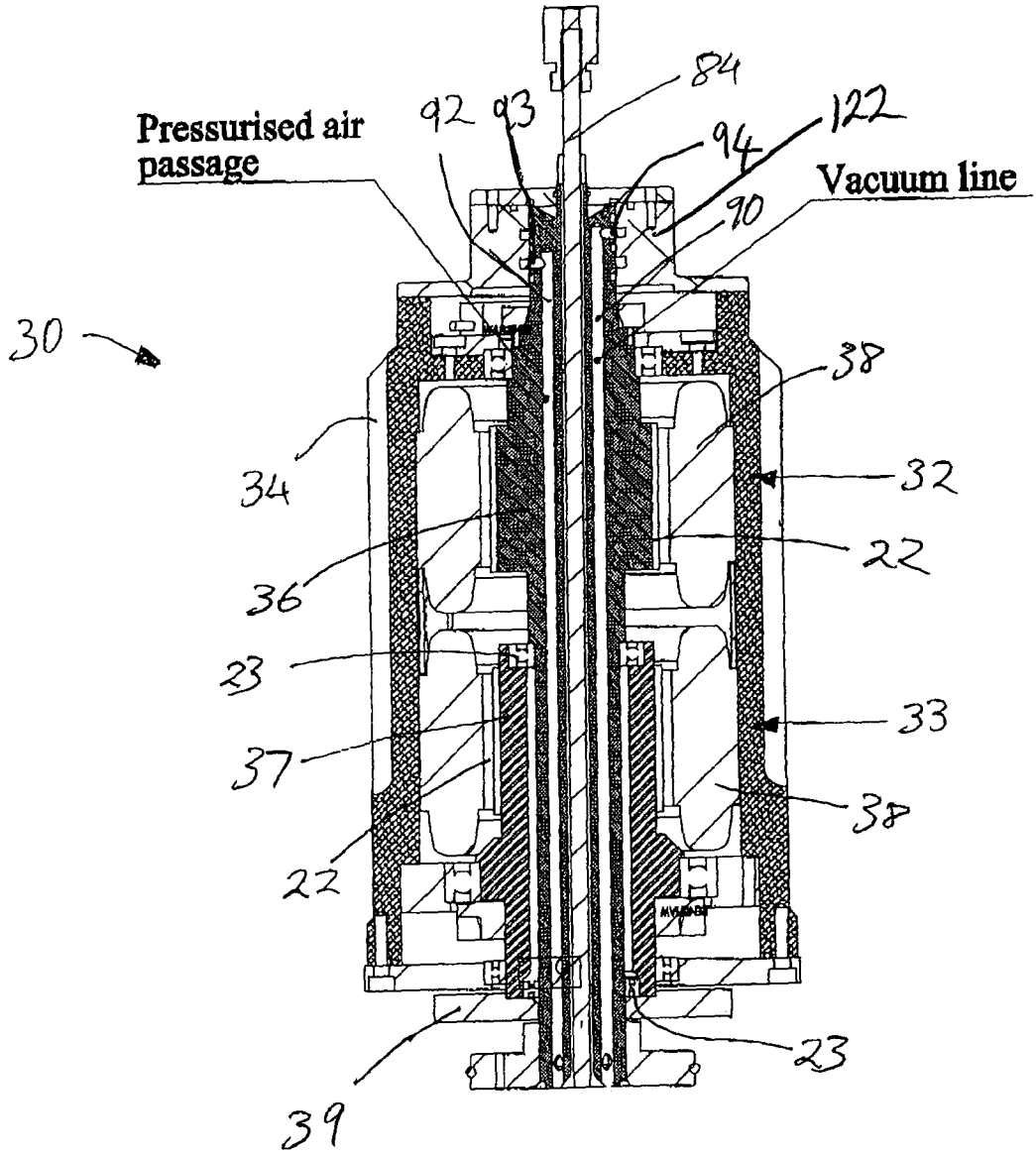
FIG. 10 is a second side sectional view of the apparatus taken at section E-E of FIG. 9(*a*)

Air inlet 93 and vacuum inlet 94 are connected to the air passage 92 and vacuum passage 90 respectively through a rotary connector 95 that acts as a stationary interface against the rotating delivery column to allow for the column rotation while still allowing the air and vacuum sources to be connected to their respective passages. Accordingly, and as best shown in FIG. 3(*b*), rotary connector 95 is a cylindrical piece that sits around the delivery column 20 over the entry points of the air and vacuum passages. As illustrated in FIG. 10 of the second embodiment, the stationary cylindrical housing 122 sits around and over the entry points of the air and vacuum passages. Rotary connector 95 and cylindrical housing 122 remain still while delivery column rotates within an internal bore 97 of the connector/cylindrical housing. Rotary connector and cylindrical housing 122 carry the air inlet 93 and vacuum inlet 94, which also remain stationary and to which the air and vacuum sources are connected via conduits (not shown).

On the internal bore 97 of the connector/cylindrical housing are two grooves 98. Grooves 98 are each in communication with one of the air inlet 93 or vacuum inlet 94 and ensure that regardless of the position of the air and vacuum passages relative to their respective inlets, air will reach the entry point of the air and vacuum passages via the grooves. O-rings 99 located above and below each groove prevent leakage of air from the grooves. This arrangement allows air and a suction of air through the vacuum to be delivered through the delivery column even while it continuously rotates.

FIGS. 8 to 12 illustrate a second and improved embodiment of a waterjet cutting apparatus 30 described above. In the second embodiment, errors that may be encountered in the first embodiment are reduced, accuracy is increased, and play and damage to assembly parts is also reduced. Parts shown in the second embodiment of the waterjet cutting apparatus 30 that are the same parts as in the first embodiment are referred to using the same reference numerals.

Waterjet cutting apparatus 30 has a reduced number of gears, thereby reducing the probability of component failure. As illustrated in FIGS. 9 and 10 there are no gears between the drives and a central rotating and delivery column (tilt head rotor 36) along the vertical axis. In this embodiment the drives for the tilt head assembly 40 and the rotary head assembly 60, namely tilt head drive 32 and the rotary head drive 33 respectively, are located centrally along the vertical axis 15 so as to directly drive the rotary head assembly 60 and the tilt head assembly 40. The drives are arranged one above the other to have one common rotor axis at the vertical axis 15 such that rotary movement and tilting movement of the cutting head in the fourth and fifth axis is dependent and continuous. Namely, rotation of the cutting head will affect tilting of the cutting head, and vice versa.

FIGS. 9 and 10 illustrate a cylindrical stator housing 34 supported on a support plate 35 that is cantilevered from a Z-axis slider 18 (FIG. 8) located in the part of the larger waterjet cutting machine (not shown) that controls the X, Y and Z-axis movement of the cutting head. In a preferred embodiment the tilt head and rotor head drives 32, 33 are 50 Amp servo motors operating at 600V. The drives are housed inside the stator housing one above the other with a common rotor axis. The interior upper half of the stator housing 34 is lined with a ring of 11 Nm stators 38 corresponding to the tilt head drive, while the interior lower half of the housing is lined with similar stators 38 corresponding to the rotor head drive.

Running axially central through the housing 34 and between the rings of stators is a solid tilt head rotor 36, or tilt drive shaft, which, as previously described, doubles as the delivery column, namely carrying the air passage 92, water passage 84, vacuum passage 90 and the garnet passage 87. An encoder 88 positioned towards the upper end of the tilt head rotor 36 tracks movement of the cutting head. A second encoder is also positioned towards the lower end of the drive which tracks the rotation of the rotary head.

At its upper half tilt head rotor 36 has an enlarged shoulder on which magnets 22 are attached facing tilt head drive stators 38. Accordingly, electrically charging the stators causes tilt head rotor 36 to rotate by way of magnets 22, and thereby driving the tilt head assembly.

A hollow rotary head rotor 37, or rotary drive shaft, is located within housing 34 and coaxially surrounds a lower half of the tilt head rotor 36. Bearings 23 located between rotors 36 and 37 ensure the two rotors spin independently of one another. Rotary head rotor 37 is also bearing mounted in housing 34 to spin freely relative thereto. The exterior of rotary head rotor 37 is provided with magnets 22 which, by way of lower stators 38, cause rotary head rotor 37 to spin, thereby driving the rotary head assembly.

Figure 11:
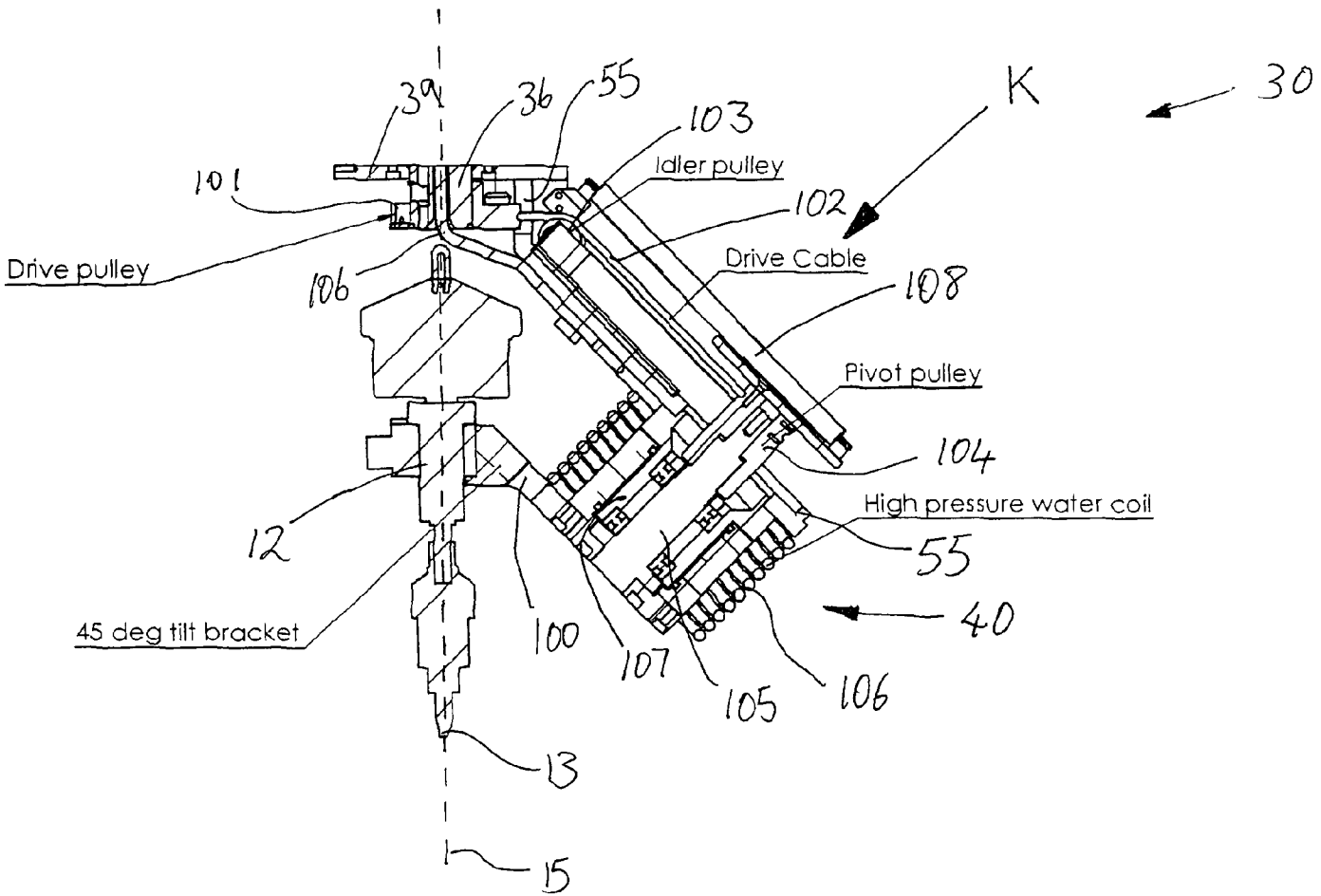
FIG. 11 is a side sectional view of a lower half of the apparatus taken at section J-J of FIG. 8.

Rotary head rotor 37 extends out of the bottom of stator housing 34 and is fixed to a rotating bracket 39. FIG. 11 illustrates rotating bracket 39 supporting the tilt head frame 55 below bracket 39. The tilt head frame 55 carries the tilt head assembly 40. Accordingly, rotary head drive 33 rotates rotating bracket 39 which in turn spins the tilt head assembly, and therefore the cutting head 12, along the vertical axis 15 thereby defining the cutting head's fourth axis of movement.

Tilt head rotor 36 extends out from the top of stator housing 34 to connect to water, air and garnet services. The bottom of tilt head rotor 36 extends through the bottom of housing 34 and connects to drive tilt head assembly 40 causing the cutting head to tilt from the vertical axis 15 and around a horizontal axis thereby defining a fifth axis of movement.

As illustrated in FIG. 11, tilt head assembly in the second embodiment is approximately angled 45° from the a horizontal plane (or from the vertical axis 15) such that the axis about which the cutting head tilts is also at 45° to the horizontal. This is different from the first embodiment illustrated in FIGS. 1 to 7 where the tilt head assembly 40 is tilted about the horizontal axis. The advantage with the arrangement of the second embodiment is that, in theory, the vertex of tilt should remain at the end of the nozzle 13 which means the nozzle end remains in the same location during tilt thereby enabling greater cutting accuracy and a reduction in error during cutting head movement.

Figure 12:
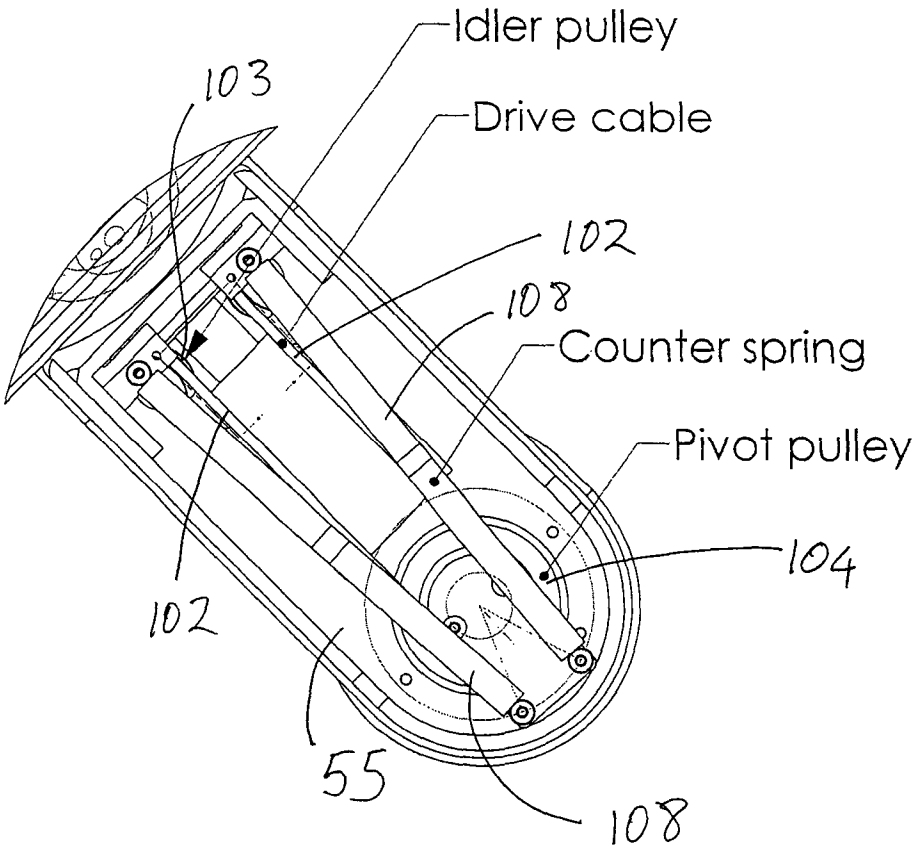
FIG. 12 is a front view of the lower half of the apparatus as seen from the direction of arrow K in FIG. 11.

Tilting is brought about by a cable driven pulley system which pivots a tilt bracket 100 to which the cutting head 12 is attached. A drive pulley 101 mounted to the end of tilt head rotor 36 drives a cable 102 over idler pulleys 103 to pivot a pivot pulley 104. FIG. 12 best illustrates the pulley system and the manner in which it is mounted on tilt head frame 55. FIG. 11 illustrates how tilt head frame 55 is mounted at a 45° angle to the vertical axis 15.

Pivot pulley 104 lies in a parallel plane to tilt bracket 100 and is connected to tilt bracket 100 by way of shaft 105 such that pivoting movement of the pivot plate 104 will cause corresponding pivoting movement of the tilt bracket 100 and hence the same tilt to the cutting head 12 and nozzle 13. The degree of tilt to the cutting head achievable by the tilt head assembly is greater than ±12°, typically ±60° but it is envisaged to reach as high as ±180° allowing full robotic control.

Using a cable driven pulley system eliminates backlash in operating the tilt head assembly. Furthermore, a cable drive is particularly suited to waterjet cutting machines as the components will not be affected by splashing of the abrasive waterjet.

High pressure water is fed down through tilt head rotor 36 and to the cutting head 12 by a high pressure water line 106 which, at the tilt head assembly, is coiled around shaft 105 and supported thereon by a sleeve 107. Sleeve 107 is mounted on bearings on the shaft to allow the coiled water line to move freely of the pivoting shaft 105. For the sake of clarity the water line extending between the coil and the cutting head is not shown. Coiling of the water line allows for extension and contraction of the water line when the cutting head is tilted.

An alternative to using a coiled high pressure water line would be to provide a rotary joint in the water line between the tilt head assembly and the cutting head.

As the cutting head 12 tilts, the water line 106 at the coil moves from a neutral position to a more extended or a more contracted position, depending on the direction of tilt. In order to assist in driving the cutting head away from the neutral position and against the resistance imposed by the water line, two counter springs 108 are attached between the pivot pulley 104 and the tilt head frame 55. Each spring moves the coiled water line away from the neutral position in the tilt direction.

Provision of a counter spring arrangement relieves the resistance of the high pressure coil from the tilt head drive when tilting the cutting head away from the vertical position. In other words, the tilt head drive need only require sufficient force to drive tilting movement of the cutting head; the resistive force created by the coiled water line is compensated for by the counter springs. The features in the second embodiment of the direct drives and the 45° angled tilt bracket provides a profile cutting apparatus having great accuracy and a minimized chance of errors, damage and part failure.

In operation, the rotating rotary head assembly spins the tilt head assembly and hence the nozzle. The dependent tilt action to the spinning cutting head allows the nozzle to describe a continuous circular/spiral cutting path driven by the differential motion of the drives. The present waterjet cutting apparatus accordingly introduces new dimensions to profile cutting that increase the possibilities of cutting paths and machine manoeuvrability for more efficient, controlled and sophisticated profile cutting.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The claims defining the invention are as follows:

1. A profile cutting apparatus comprising: a cutting head supporting a nozzle through which a cutting medium passes, and at least two drives that drive the cutting head to tilt relative to a vertical axis while driving the cutting head to rotate about the vertical axis, wherein the tilt of the cutting head is achieved by the relative difference in motion between the two drives.

2. The profile cutting apparatus claimed in claim 1, wherein the drives each include a drive shaft and the tilt of the cutting head is achieved by the relative difference in speed and angular displacement between the drive shafts.

3. The profile cutting apparatus claimed in claim 1, wherein the point of tilt of the cutting head is at the end of the nozzle.

4. The profile cutting apparatus claimed in claim 3, wherein the drive shaft of one drive rotates a rotary assembly which supports the cutting head and rotates the cutting head around the vertical axis, and the other drive shaft drives a tilt assembly supported on the rotary assembly and tilts the cutting head relative to the vertical axis.

5. The profile cutting apparatus claimed in claim 1, wherein the drives are motors located on the vertical axis to directly drive a tilt head assembly for tilting the cutting head, and to directly drive a rotary head assembly for rotating the cutting head, the motors having respective drive shafts.

6. The profile cutting apparatus claimed in claim 2, wherein the drive shafts are concentrically aligned one within the other and are independently rotatable.

7. The profile cutting apparatus claimed in claim 5, wherein a delivery column extends concentrically within the drive shafts, the delivery column being rotatable with the cutting head and having a channel to deliver the cutting medium to the cutting head.

8. The profile cutting apparatus claimed in claim 7, wherein the cutting medium is high pressure water entrained with garnet, and the delivery column has channels to deliver garnet, high pressure water and air through the column and to the cutting head.

9. The profile cutting apparatus claimed in claim 7, wherein the inner drive shaft is the delivery column.

10. The profile cutting apparatus claimed in claim 4, wherein the tilt head assembly includes a cable driven pulley system which pivots a bracket to which the cutting head is attached thereby tilting the cutting head.

11. The profile cutting apparatus claimed in claim 9, wherein a water line for supplying high pressure water to the cutting head is wound on the tilt head assembly and is pivotable to move with the tilting cutting head, and counter springs assist in causing the water line to pivot with the tilting cutting head.

12. The profile cutting apparatus claimed in claim 1, wherein the apparatus is mounted on a frame capable of moving the cutting head assembly in the three linear spatial directions which, together with the rotating and tilt movements of the apparatus, constitute a five axis profile cutting machine.

13. A profile cutting apparatus comprising: a cutting head supporting a nozzle through which a cutting medium passes, at least two drives that drive the cutting head to tilt relative to a vertical axis while driving the cutting head to rotate about the vertical axis, and a delivery column through which cutting medium passes from a top thereof and which rotates with the cutting head so that a conduit can deliver the cutting medium from the bottom of delivery column to the cutting head without twisting.

14. The profile cutting apparatus claimed in claim 13, wherein the delivery column is cylindrical and contains a channel, the top of the delivery column being rotatable within a stationary cylindrical housing having an inlet through which the cutting medium is delivered into a sealed gap between the delivery column and cylindrical housing and into the channel.

15. The profile cutting apparatus claimed in claim 13, wherein the cutting medium is high pressure water entrained with garnet, the garnet being delivered into the channel of the delivery column under vacuum.

16. The profile cutting apparatus claimed in claim 15, wherein the delivery column includes further channels for the passage of high pressure water, low pressure air and pressurised air, with respective conduits connecting the water and air exiting from the channels at the bottom of the delivery column to the cutting head.

17. The profile cutting apparatus claimed in claim 16, wherein the inlet for the high pressure water into the delivery column is through a swivel joint.

18. The profile cutting apparatus claimed in claim 16, wherein the inlets for the low pressure and pressurised air into the delivery column are through sealed gaps between the stationary cylindrical housing and the delivery column.

* * * * *